US005212709A

United States Patent [19]

Mihm

[11] Patent Number: 5,212,709

[45] Date of Patent: May 18, 1993

[54] FREQUENCY MODULATED PHOTON EXCITED LIGHT SOURCE

[76] Inventor: Daniel C. Mihm, P.O. Box 8122, Ft. Wayne, Ind. 46898

[21] Appl. No.: 731,144

[22] Filed: Jul. 15, 1991

Related U.S. Application Data

[63] Continuation-in-part of Ser. No. 447,195, Dec. 7, 1989, abandoned.

[51] Int. Cl.[5] ..... H01S 3/09

[52] U.S. Cl. ..... 372/69; 315/248; 315/39; 362/259; 362/260

[58] Field of Search ..... 362/259, 260; 372/6, 372/69; 350/96.15; 250/365; 315/248, 39

[56] References Cited

U.S. PATENT DOCUMENTS

| | | | |
|---|---|---|---|
| 4,213,153 | 7/1980 | Schäfer | 250/365 |
| 4,309,746 | 1/1982 | Rushworth | 362/259 |
| 4,586,115 | 4/1986 | Zimmerman et al. | 362/260 |

*Primary Examiner*—Leon Scott, Jr.

[57] ABSTRACT

This invention relates means for illumination of sealed bulbs containing an predetermined inner gaseous environment to be excited to a spontaineous emission predominately by frequency modulated photon pumped into sealed bulb through a fiber-optic waveguide by a laser, said waveguide being clad where is extends from laser and is coupled to sealed bulb and unclad where it extends through sealed bulb, and further has an intragally formed reflective end section for provisions of feedback of frequency modulated photons through the waveguide core at the output end, thereby producing counter-travelling photons within the waveguide causing said photons to collide at a variety of incident angles as to cause photons to be emitted from the unclad waveguide within sealed bulb therefore stimulating the inner gaseous environment to a spontaineous emission which in turn stimulates a frequency modulated fluorescent photon interaction coating source which creates visible light.

12 Claims, 1 Drawing Sheet

FREQUENCY MODULATED PHOTON EXCITED LIGHT SOURCE

This is a continuation-in-part of application Ser. No. 07,447,195; filed: Dec. 7, 1989, abandoned; titled: Frequency Modulated Photon Excited Light Source. Cross-References to Related applications: U.S. Pat. Nos. 4,693,545; 4,680,767; 4,255,017; 4,923,279; 4,652,790; 3,993,927; 4,001,632.

BACKGROUND OF INVENTION

The present invention utilizes an electric current which is placed across electrodes at both ends of a sealed bulb, which has a fluorescent material on its inner diameter and is filled with various gases or vapors, which are subjected to electron bombardment emitted from the electrodes, causing collisions with the outer electrons in orbit around the nucleous of the atoms of gas causing disruption of the atom's electron orbit, wherein ultraviolet photon energy is created, which in turn strikes the fluorescent coating on the inner diameter of the bulb causing it to emit visible light. It happens that an electron disruption of a low pressure mercury vapor produces an abundance of one particular wavelength in this short-wave ultraviolet region and phosphors are selected and blended to respond efficiently at that wavelength as to produce different colors of visible light.

Fluorescent compounds can be conveniently divided into two classes: those excited by higher frequency and thos excited by lower frequency ultraviolet radiation. This radiation occurs when a gas or vapor is electrically excited and this emission may take place in a series of steps, each step from a highly excited state to some lower state of excitation being marked by radiation at a wavelength peculiar to that step. The many millions of excited atoms enclosed in a discharge tube thus returns to normal by one or more stages; some in two, others in three, and so on: but with any given conditions of pressure, current density, etc., in a particular gas or vapor, the relative numbers of atoms returning to their normal state by any of the alternative paths is fixed at a definite proportion of the whole. Each of the radiations characteristic of the gas or vapor are therefore emitted, but some are stronger than others; and by careful control of the current density and pressure it is possible to some extent to alter the relative strengths of these radiations.

SUMMARY OF THE INVENTION

According to the present invention, an electrodeless light source is provided in which the problems mentioned have been overcome. More specifically, the light source utilizes stimulated atomic emission, comprising: a laser (4) producing photons of a predetermined modulated frequency; a sealed bulb 7 which contains a predetermined inner gaseous environment, and a predetermined frequency modulated fluorescent photon interaction coating source on the inner walls; and a fiber-optic waveguide 5 coupled to said laser and extending through said gaseous environment, contained within said sealed bulb 7; said waveguide 5 being clad with a material with more density than that of the waveguide core 6; where it is coupled to said laser 4 and extending to said sealed bulb 7 and unclad as it extends through said gaseous environment contained within said sealed bulb 7, and further said waveguide 5 has an intragally formed reflective end section 9 for provisions of feedback of frequency modulated photon through the waveguide core 6 at the output end, said predetermined frequency modulated photon being pumped through said waveguide 5 by said laser 4 thereby producing counter-travelling photons within the waveguide 5 thereby increasing the intensity of photon emission within the waveguide 5, thereby enhancing the probability of photon collision at a variety of incident angles as to cause photons to be emitted from the portion of unclad waveguide 6 within said sealed bulb 7 therefore stimulating the inner gaseous environment to a spontaineous emission which in turn stimulates a frequency modulated fluorescent photon interaction coating source on the inner diameter of the sealed bulb 7 thereby producing cold light without electrical stimulation to start a photon emission, therefore eliminating direct electrical stimulation. This is best understood by looking at the physicist's favorite example, the simple hydrogen atom, in which a single electron orbits a nucleous consisting of a single proton. There is a unique quantum number assigned to each orbit, which, along with the energy level, increases with the distance from the nucleous. The innermost orbit has a quantum number of one, and when it is occupied, the atom is in its lowest energy level. Hydrogen's single electron tends to occupy the lowest-energy, the innermost orbit, and while there, the electron and the atom are said to be in the ground state. To achieve a higher orbit an electron needs energy. A photon is a particularly convenient bundle of energy. When a photon of sufficient modulated frequency comes along, the electron absorbs the photon and jumps into a higher orbit. The electron (and the atom) are then said to be in an excited state. The electron cannot remain excited for long, however, and soon—generally within a tiny fraction of a second—drops back down to its ground state. When it does so, it must get rid of its extra energy, which it does by emitting a photon, a photon of the same energy and wavelength as the one it has just absorbed. This process is called spontaineous emission.

Inasmuch, the old process of finding a gas capable of precise emissions of radiation upon disruption of electron orbit due to electron bombardment is to say the least very limited. Many varieties of gas can absorb frequency modulated photons, emitting same; thus the variety and or color of light could be accomplished the same as it always has, simply by introducing the desired wavelength needed for stimulation of the frequency modulated fluorescent photon interaction coating source in the form of frequency modulated photons to the same gases or vapors and fluorescent compounds now used. However this art is now not limited to three basic types of gases or vapors and seven fluorescent powders or phosphors, however any gas or vapor capable of absorbing photons of a predetermined wavelength and emitting photons of the same exciting wavelength and further gases like nitrogen, oxygen, argon, neon, helium, krypton and xenon, etc. may now be made to emit ultraviolet energy for interaction with frequency modulated fluorescent photon interaction coating sources making color output almost limitless.

DESCRIPTION OF PREFERRED EMBODIMENTS

Figure 1:
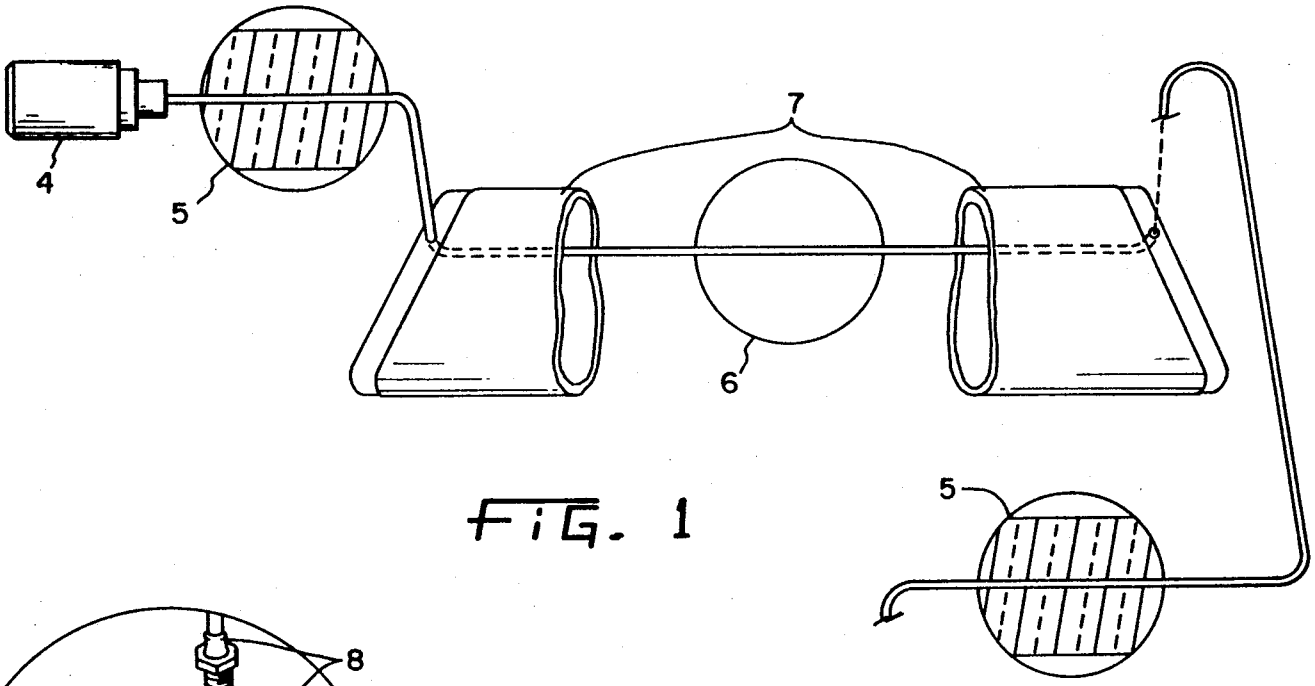
FIG. 1 is a block diagram of the improved light source according to the present invention.
Figure 3:
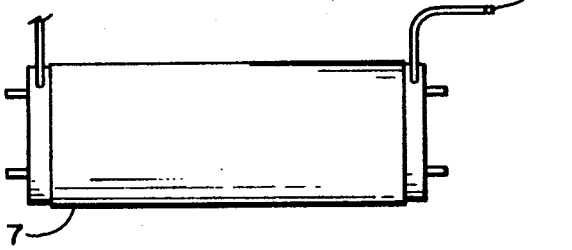
FIG. 3 is a block diagram of the sealed bulb in a series connection with the block diagram of FIG. 1.

In an exemplary embodiment of the present invention, as illustrated in FIGS. 1 and 3, a light source, indicated generally by the reference numeral 7, includes a laser 4, pumping photons of a predetermined modulated frequency through a fiber-optic waveguide 5, which is coupled 8 to a sealed bulb 7. Said waveguide being clad with a material with more density than that of the waveguide core 6. The waveguide core 6 extending through the sealed bulb 7 containing a predetermined inner gaseous environment being unclad, and further the waveguide 5 of FIG. 3 has an integrally formed reflective end section 9 for provisions of feedback of frequency modulated photons through the waveguide core 6 at the output end, thereby increasing the intensity of photon emission within the waveguide 5, thereby enhancing the probability of photon collision at a variety of incident angles as to cause frequency modulated photons to be emitted from the unclad waveguide core 6 into sealed bulb 7, containing an inner gaseous environment, thereby stimulating the inner gaseous environment to a spontaineous emission, which in turn stimulates a frequency modulated fluorescent photon interaction coating source on the inner diameter of the sealed bulb 7, thereby creating visible light.

Figure 2:
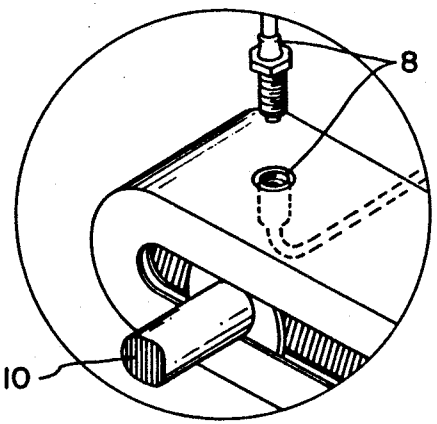
FIG. 2 is a sectional view of a preferred embodiment for connection to and from sealed bulb and moveable bulb mounting pins.

For the FIG. 2 embodiment, the sectional view, the connectors 8 are of a screw in type to allow easy bulb 7 to bulb 7 series connection and the movable pins 10 are designed to take advantage of prexisting lighting fixtures.

What is claimed is:

1. A lighting system utilizing stimulated atomic emission, comprising: a laser producing photons of a predetermined modulated frequency; a sealed bulb which contains a predetermined inner gaseous environment, and a predetermined frequency modulated fluorescent photon interaction coating source on the inner walls; and a fiber-optic waveguide coupled to said laser and extending through said gaseous environment contained within said sealed bulb; said waveguide being clad with a material with more density than that of the waveguide core; where it is coupled to said laser and extending to said sealed bulb and unclad as it extends through said gaseous environment contained within said sealed bulb, and further said waveguide has an intragally formed reflective end section for provisions of feedback of frequency modulated photon through the waveguide core at the output end, said predetermined frequency modulated photon being pumped through said waveguide by said laser thereby producing counter travelling photons within the waveguide thereby increasing the intensity of photon emission within the waveguide, thereby enhancing the probability of photon collision at a variety of incident angles as to cause photons to be emitted from the portion of unclad waveguide within said sealed bulb, therefore stimulating the inner gaseous environment to a spontaineous emission which in turn stimulates a frequency modulated fluorescent photon interaction coating source on the inner diameter of the sealed bulb thereby producing cold light without electrical stimulation to start a photon emission, therefore eliminating direct electrical stimulation.

2. A lighting system of claim 1 in which said fiber-optic waveguide is unclad where it extends through sealed bulb and clad where it extends from laser to sealed bulb.

3. A lighting system of claim 2 in which said fiber-optic waveguide has an intragally formed reflective end section for provisions of feedback of frequency modulated photon through the waveguide core at the output end.

4. A lighting system of claim 3 in which a laser produces photons of a predetermined modulated frequency.

5. A lighting system of claim 4 in which said frequency modulated photons are pumped through said fiber-optic waveguide by a laser.

6. A lighting system of claim 5 in which said fiber-optic waveguide travels through said sealed bulb containing an inner gaseous environment.

7. A lighting system of claim 6 in which said gaseous environment comprises a frequency modulated photon interaction source.

8. A lighting system of claim 7 in which said frequency modulated fluorescent photon interaction coating source is altered in its visible light spectrum output by manipulation of applied modulated frequency.

9. A lighting system of claim 8 in which said frequency modulated fluorescent photon interaction coating source is altered in its visible light spectrum output by manipulation of gaseous environment composition.

10. A lighting system of claim 9 in which said frequency modulated florescent photon interaction coating source is altered in its visible light spectrum output by the manipulation of photon source wattage.

11. A lighting system of claim 10 in which said frequency modulated fluorescent photon interaction coating source is stimulated by the spontaineous emission of the gaseous environment.

12. A lighting system of claim 11 in which said spontaineous emission is created by frequency modulated photon interaction within gaseous environment.

* * * * *